US006477237B1

(12) United States Patent
Taniguchi et al.

(10) Patent No.: US 6,477,237 B1
(45) Date of Patent: Nov. 5, 2002

(54) X-RAY SHIELDING MECHANISM FOR OFF-AXIS X-RAYS

(75) Inventors: Seiichi Taniguchi, Miyanohigashi-machi (JP); Akimichi Kira, Miyanohigashi (JP); Kozo Kashihara, Miyanohigashi (JP)

(73) Assignee: Horiba, Ltd., Kyoto (JP)

( * ) Notice: Subject to any disclaimer, the term of this patent is extended or adjusted under 35 U.S.C. 154(b) by 0 days.

(21) Appl. No.: 09/661,989

(22) Filed: Sep. 14, 2000

(30) Foreign Application Priority Data

Sep. 17, 1999 (JP) ..... 11-264561

(51) Int. Cl.[7] ..... G21K 2/00

(52) U.S. Cl. ..... 378/145; 378/147

(58) Field of Search ..... 378/145, 147, 378/43

(56) References Cited

U.S. PATENT DOCUMENTS

| | | | | | |
|---|---|---|---|---|---|
| 2,578,722 | A | * | 12/1951 | McCartney et al. | 250/52 |
| 3,143,651 | A | * | 8/1964 | Giacconi et al. | 250/105 |
| 4,317,036 | A | * | 2/1982 | Wang | 250/274 |
| 4,979,203 | A | * | 12/1990 | Suckewer et al. | 378/206 |
| 5,001,737 | A | * | 3/1991 | Lewis et al. | 378/147 |
| 5,621,780 | A | * | 4/1997 | Smith et al. | 378/65 |
| 5,682,415 | A | * | 10/1997 | O'Hara | 378/147 |
| 5,816,999 | A | * | 10/1998 | Bischoff et al. | 600/3 |
| 5,912,939 | A | * | 6/1999 | Hirsch | 378/43 |
| 5,926,522 | A | * | 7/1999 | McCarthy et al. | 378/84 |

* cited by examiner

*Primary Examiner*—Robert H. Kim
*Assistant Examiner*—Irakli Kiknadze
(74) *Attorney, Agent, or Firm*—Price and Gess

(57) ABSTRACT

An X-ray shielding mechanism to block off-axis X-rays for example, in an X-ray analytical instrument such as a fluorescent X-ray spectroscope is provided. X-rays are guided on-axis by elongated glass guide tubes and outer elongated metallic protective pipes are spatially positioned on the exterior of the glass guide tubes to block off-axis X-rays.

11 Claims, 3 Drawing Sheets

X-RAY SHIELDING MECHANISM FOR OFF-AXIS X-RAYS

BACKGROUND OF THE INVENTION

1. Field of the Invention

The present invention relates to an X-ray shielding mechanism to block off-axis X-rays in, for example, an X-ray cartridge of an X-ray analysis microscope.

2. Description of the Prior Art

FIG. 3 shows a basic structure of a fluorescent X-ray spectroscope which is an example of an X-ray analysis microscope using an X-ray cartridge 10. In FIG. 3, 2 represents an X-ray source, which has a filament 2*a* and a target 2*b*. The point at which electron current emitted from the filament 2*a* collides with the target 2*b* is an X-ray generating point P.

3*a* and 3*b* respectively represent X-ray guide tubes which are made of glass and are used to narrow X-rays Rx radiated from the X-ray generation point P and to irradiate a sample S with the X-rays Rx. As the X-ray guide tubes, two tubes having inside diameters of, for example, 10 $\mu$m and 100 $\mu$m are prepared. In the structure of this example, these X-ray guide tubes 3*a* and 3*b* are supported by a mount base 4. The mount base 4 slides in a direction horizontal (in the figure) to the X-ray source 2, whereby either one of the X-ray guide tubes 3*a* and 3*b* is selected and the sample S is irradiated with the X-rays Rx which are made to be in a properly narrowed condition.

Also, the above X-ray source 2 has an insertion portion 2*c* which is concaved therein for inserting the X-ray guide tubes so that the input ends of the X-ray guide tubes 3*a* and 3*b* can be brought closer to the X-ray generated point P, enabling more intense radiation of the X-rays Rx. In addition, the X-rays Rx applied to a portion other than an X-ray transmission window 2*d* are blocked so that the X-rays Rx are attempted to be applied to only the inside of either one of the X-ray guide tubes 3*a* and 3*b*. The X-rays Rx applied out of the inner peripheries of the X-ray guide tubes 3*a* and 3*b* are designed to be absorbed by the glass constituting the X-ray guide tubes 3*a* or 3*b*.

The sample S is mounted on a sample stage 11 which can move in X-Y directions and the position of the sample S can be controlled by a computer 12 through a stage control circuit 11*a*. The spectroscope is also provided with a detector 13 for detecting various fluorescent X-rays Rf generated from the sample S and provides a signal to a process circuit 14 which outputs the detected X-rays Rf as, for example, a fluorescent X-ray spectrum to the computer 12. Namely, in this structure, the control of the stage 11 in the direction of X-Y axes is made by the computer 12 to enable the reproduction of the mapping image of element distribution in a sample by using fluorescent X-ray spectroscopy.

However, in order to block the X-rays Rx by using the X-ray guide tubes 3*a* and 3*b*, the entire length of the X-ray guide tubes 3*a* and 3*b* must be used. Also, since in the X-ray cartridge 10 having the above structure, only the X-ray transmission window 2*d* is formed on the side of the end from which the X-rays Rx are introduced and the X-rays Rx applied to the other portion are blocked, there is a possibility that the X-rays Rx applied at a relatively large divergent angle $\alpha$ pass through the outer surface of the X-ray guide tubes 3*a* and 3*b* and are eventually applied to the sample S. Specifically, there is a possibility that fluorescent X-rays Rf' generated by leaking X-rays Rx' appear as a noise.

In order not to allow such a problem to arise, as shown by the enlarged sectional view, a material like a solder cream H is applied to a space formed between each of the X-ray guide tubes 3*a* and 3*b* and a shielding portion of the mount base 4 and is soldered by heating to prevent the sample S from being irradiated with the X-rays Rx' which have penetrated the X-ray guide tubes 3*a* and 3*b*. This, in turn, gives rise to the problem that laborious works of, for instance, applying the solder cream H are required, thereby increasing the cost to make the X-ray cartridge 10.

On the other hand, it is considered that a shielding plate is disposed on the side of the end from which the X-rays Rx are emitted. However, it is of importance to bring the X-ray guide tubes 3*a* and 3*b* close to the sample S in order to prevent the focus from being blurred. Disposing a shielding plate between the X-ray guide tubes 3*a* and 3*b* and the sample S can cause the guide tubes to be distant from the sample S and is hence undesirable. Also, there is a possibility that an observation field by visual observation and a monitor would be blocked by the shielding plate disposed on the side of the end from which the X-rays Rx are emitted.

SUMMARY OF THE INVENTION

The present invention has been provided taking the above situation into consideration and has an object of providing an X-ray shielding mechanism which can block leaking X-rays other than the X-rays collected by an X-ray guide tube.

The above object is attained by an X-ray shielding mechanism being provided with an X-ray cartridge comprising an X-ray source which radiates X-rays and a glass X-ray guide tube with an inner peripheral surface into which the X-rays are introduced, the cartridge further comprising a metallic protective pipe which is disposed outside of the X-ray guide tube whereby the X-rays which are transmitted from the side surface of the X-ray guide tube can be blocked.

Accordingly, it is possible to allow the X-rays to be reflected by the inner peripheral surface of the X-ray guide tube and to be narrowed so that the X-rays have a proper radiation area. Also, the X-rays transmitted from the side surface of the X-ray guide tube can be blocked. It is therefore possible to completely limit the area irradiated with the X-rays. As a consequence, the use of this leaking X-ray shielding mechanism enables it possible to eliminate an adverse effect produced by the leak X-rays to carry out an analysis with high accuracy.

A leaking X-ray shielding mechanism according to a second aspect of the present invention is provided with an X-ray cartridge comprising an X-ray source which radiates X-rays and a glass X-ray guide tube with an inner peripheral surface into which the X-rays are introduced, the cartridge further comprising an X-ray shielding plate which is made of a metal, has a window for introducing X-rays into the X-ray guide tube and is disposed on the side of the input end of the X-ray guide tube and a metallic protective pipe which has a predetermined length extending from the side of the input end at a predetermined distance from the X-ray source to the side of the end, from which the X-rays are emitted, and which is disposed outside of the X-ray guide tube whereby the X-rays which pass through the entrance window and is transmitted from the side surface of the X-ray guide tube can be blocked.

According to the above leak X-ray shielding mechanism, only X-rays passing through the X-ray guide tube can be applied to a sample and hence the area irradiated with X-rays can be surely decreased that much more. Accordingly, measurement errors caused by leaking X-rays can be prevented.

When the relation, $r_{1/x1}<r_2/x_2$, is established between the diameter $r_1$ of the entrance window of the X-ray shielding plate, the distance $x_1$ from the X-ray generating point of the X-ray source to the X-ray shielding plate, the distance $x_2$ from the X-ray generating point to the input end of the protective pipe and the inside diameter of $r_2$ of the protective pipe, leaking X-rays can be blocked only the use of X-ray shielding in the most limited range, which reduces the production cost that much more.

When the X-ray cartridge has a plurality of X-ray guide tubes and a mount base which supports these X-ray guide tubes and switches the X-ray guide tubes to each other, making it possible to use the changed X-ray guide, the intensity and thinness of the X-rays to be applied can be changed.

When the mount base supports the metallic X-ray shielding pipe positioned outside of the X-ray guide tube and the X-ray shielding plate positioned on the side of the input end of the X-ray guide tube is supported by the X-ray shielding pipe, the X-ray shielding plate can be surely supported at a fixed position with regard to the X-ray guide tube.

BRIEF DESCRIPTION OF THE DRAWINGS

The exact nature of this invention will be readily apparent from consideration of the following detailed description in conjunction with the accompanying drawings, wherein.

DETAILED DESCRIPTION OF THE PREFERRED EMBODIMENTS

The following description is provided to enable any person skilled in the X-ray analytical instrument industry to make and use the invention and sets forth the best modes contemplated by the inventors of carrying out their invention. Various modifications, however, will remain readily apparent to those skilled in these arts, since the generic principles of the present invention have been defined herein specifically to provide an instrument with an economical X-ray shielding structure.

Figure 1:
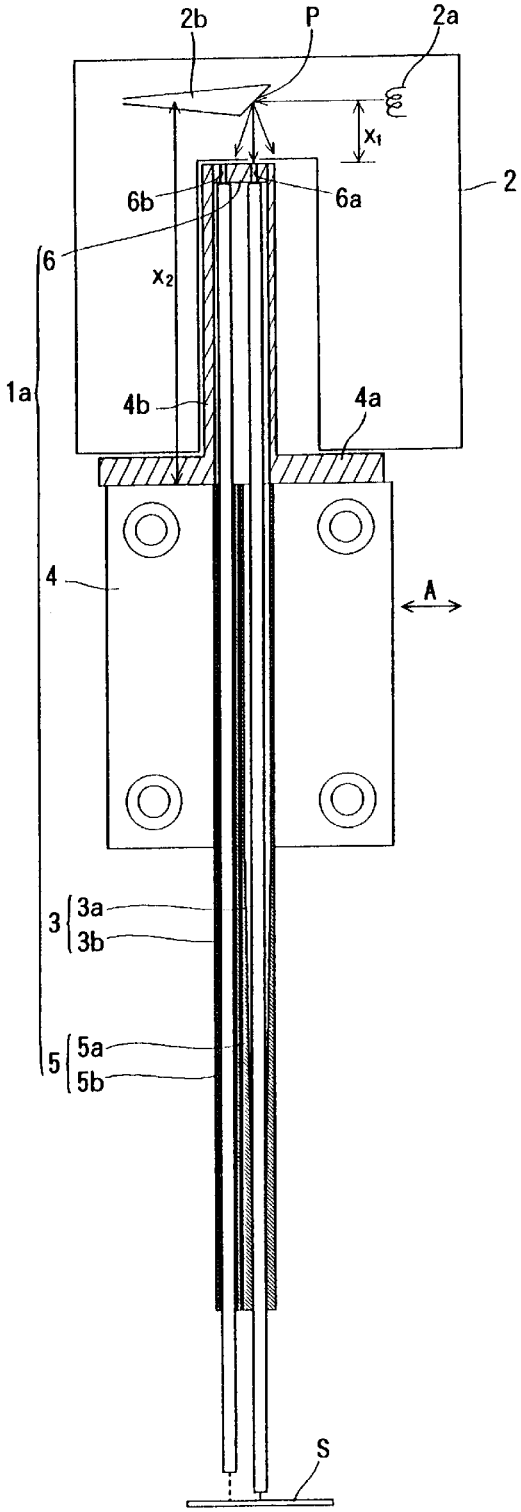
FIG. 1 is a partially sectional view for explaining an example of a leak X-ray shielding mechanism according to the present invention.
Figure 3:
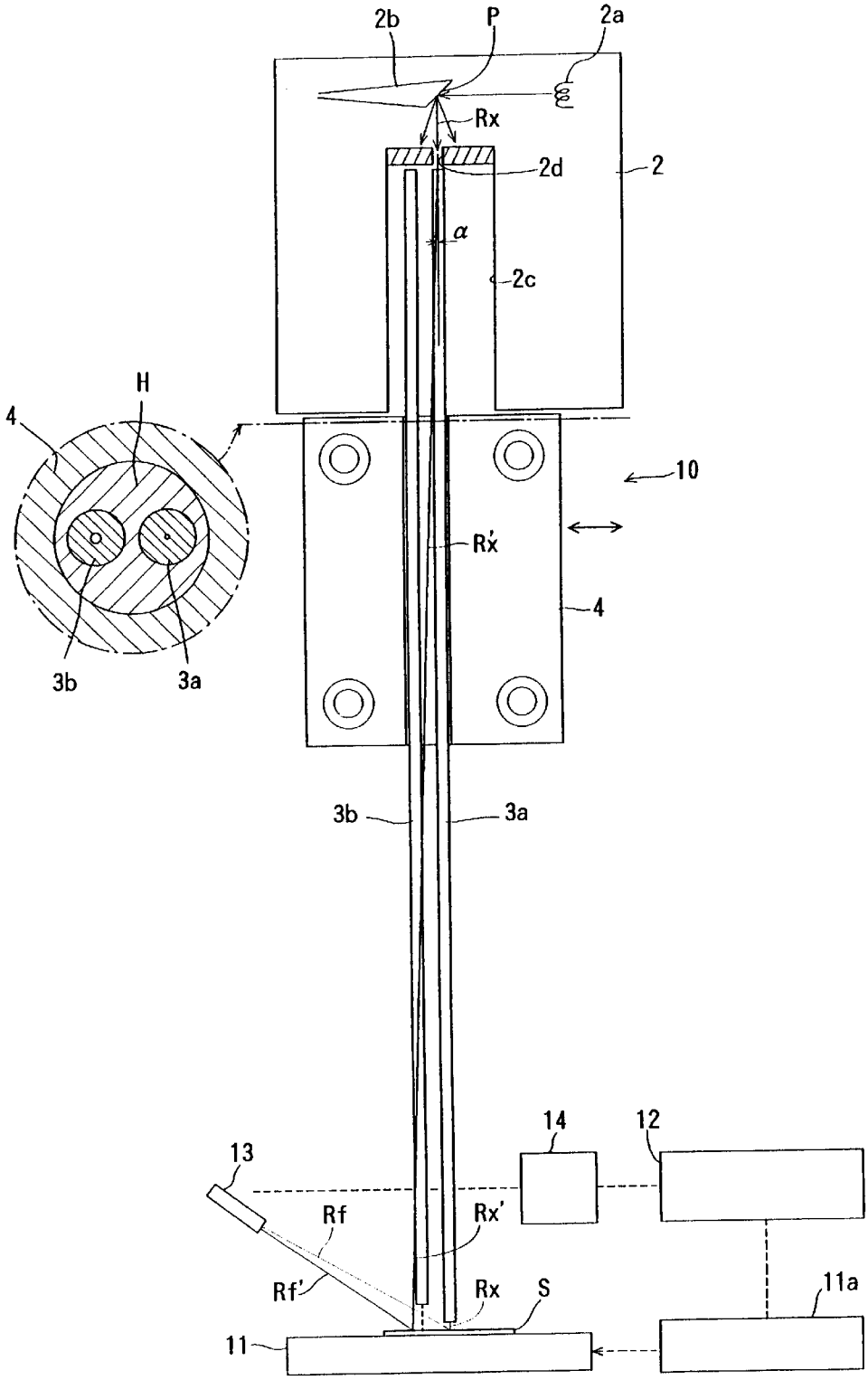
FIG. 3 is a view showing an example of a conventional X-ray analysis microscope using an X-ray cartridge.

FIG. 1 shows essential parts of a fluorescent X-ray spectroscope which is an example of an X-ray analysis microscope using a leaking X-ray shielding mechanism 1 according to the present invention. In the explanations described hereinbelow, materials represented by the same symbols as in FIG. 3 are the same or equivalent materials and detailed explanations of these materials are therefore omitted.

In FIG. 1, 1*a* represents an X-ray cartridge (hereinafter referred to as "XGT cartridge") and 2 represents an X-ray source which irradiates the XGT cartridge 1*a* with X-rays Rx. The XGT cartridge 1*a* comprises an X-ray guide tube 3, a mount base 4 mounted with the X-ray guide tube 3, a protective pipe unit 5 for the X-ray guide tube 3 and an X-ray shielding plate 6.

The X-ray guide tube 3 is a hollow glass tube used to narrow the X-rays Rx to irradiate the sample S with the narrowed X-rays Rx. In this embodiment, the X-ray guide tube 3 includes two X-ray guide tubes 3*a* and 3*b* with inside diameters of 10 $\mu$m and 100 $\mu$m, respectively. Specifically, the X-ray guide tube 3*a* with an inside diameter of 10 $\mu$m serves to condense the X-rays Rx in a thinner region to irradiate the sample, enabling an analysis with higher resolution. On the other hand, the use of the X-ray guide tube 3*b* with an inside diameter of 100 $\mu$m ensures that more intense X-rays Rx can be applied and that the measurement can be made faster. In this embodiment, these X-ray guide tubes 3*a* and 3*b* are designed to be optionally switched by the operator.

4 is an example of a mechanism by which these X-ray guide tubes 3*a* and 3*b* are switched with each other and used, and which is namely a mount base supporting these X-ray guide tubes 3*a* and 3*b*. This mount base 4 makes the above X-ray guide tubes 3*a* and 3*b* slide as shown by both arrows A to be able to use the guide tube 3*a* or 3*b* by selectively switching from one to the other.

5 represents a protective pipe unit of stainless steel or other X-ray blocking material which cover the outside of X-ray guide tubes 3*a* and 3*b*. The protective pipe unit consists of protective pipes or tubes 5*a* and 5*b*, which protect the X-ray guide tubes 3*a* and 3*b*, respectively. Also, the protective pipe unit 5 is formed of a material, such as a metal, e.g., stainless steel, which has a dense weight sufficient to prevent the transmission of X-rays over the length of the tube so that X-rays which diagonally penetrate the X-ray guide tubes 3*a* and 3*b* will not be applied to the sample S.

The above protective pipes 5*a* and 5*b* are respectively installed on the mount base 4. The length of the protective pipe unit 5 is regulated to the extent that it does not block the observation field when the sample S is monitored, specifically, its lower end portion (the side of the output end) is made to stop short of the output end of the X-ray guide tubes 3*a* and 3*b*. The protective tubes 5*a* and 5*b* can have an approximate wall thickness of 0.2 mm and an approximate length of 90 mm.

Also, an X-ray shielding pipe 4*b* made of a metal, e.g., brass, associated with flange 4*a* connected thereto is installed on the upper surface of the mount base 4. The length of this X-ray shielding pipe 4*b* is defined by the depth of the insertion portion 2*c* in the X-ray source 2. An X-ray shielding plate 6 having X-ray transmission windows 6*a* and 5*b* corresponding to the X-ray guide tubes 3*a* and 3*b* respectively is provided on the upper surface (the side of the input end) of the X-ray shielding pipe 4*b*.

The XGT cartridge 1*a* having the above structure enables the X-rays Rx from the X-ray source 2 to enter the X-ray guide tubes 3*a* and 3*b* by inserting the upper end portion (input end portion) thereof into the insertion portion 2*c* of the X-ray source 2. Then, among the X-rays Rx which are made to enter the X-ray guide tubes 3*a* and 3*b*, only the X-rays Rx passing through the hollow portion or aperture of the X-ray guide tube 3*a* or 3*b* are applied to the sample S and the remainder of the X-rays are blocked.

Figure 2:
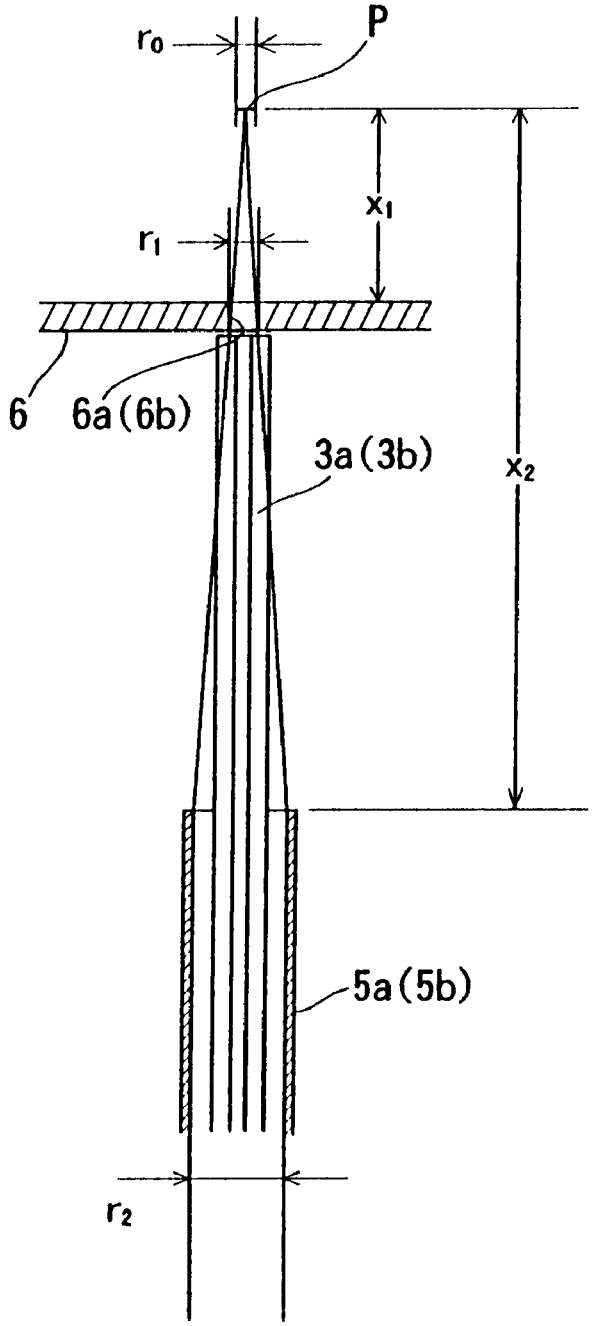
FIG. 2 is a view for explaining the positional relationships of each part of the leak X-ray shielding mechanism.

FIG. 2 is a view for explaining the positional relationship between the materials 3*a*, 5*a* and 6*a*. In the case of this embodiment, as shown in FIG. 2, the above X-ray shielding plate 6 is positioned at a distance of $x_1$ from the X-ray generating point P and the upper end portion of the above protective pipe 5 is positioned at a distance of $x_2$ from the X-ray generating point P in such a condition that, as aforementioned, the XGT cartridge 1*a* is being inserted in the insertion portion 2*c* of the X-ray source 2.

In order to block leaking X-rays without fail by the protective pipes 5*a* and 5*b* when the size of each inside diameter of the side of the input end of the protective pipes

5*a* and 5*b* is $r_2$, the size of the X-ray generated point P is $r_0$ and the deviation between the center of the X-ray guide tubes 3*a* and 3*b* and the center of the protective pipes 5*a* and 5*b* is d, the size $r_1$ of each inside diameter of the above transmission windows 6*a* and 6*b* must fulfill the relationship shown by the following inequality (1).

$$\frac{\frac{r_1}{2}+\frac{r_0\sqrt{2}}{2}}{x_1} < \frac{\frac{r_2}{2}+\frac{r_0\sqrt{2}}{2}-d}{x_2} \quad (1)$$

Here, if $r_0$ and d can be disregarded, the aforementioned equality (1) may be simplified as shown by the following formula (2). In short, it is understood that the transmission windows 6*a* and 6*b* with a size $r_1$ satisfying the inequality (2) suffice for the requirement.

$$\frac{r_1}{x_1} < \frac{r_2}{x_2} \quad (2)$$

The above structure ensures that even if the X-rays Rx emitted from the X-ray source 2 diverge, forming a broadened angle, the XGT cartridge 1*a* still has two abilities of forming fine beams of the X-rays Rx and shielding from the X-rays Rx. It is to be noted that although an example in the case of selecting the X-ray guide tube 3*a* is disclosed in FIG. 2, this is the same as the case of selecting the X-ray guide tube 3*b*.

Also, in the aforementioned embodiment, an instance in which two X-ray guide tubes 3*a* and 3*b* are switched with each other to make it possible to irradiate the sample S with X-rays Rx with different diameters is explained. However, the present invention is not limited to this instance. Specifically, one fixed X-ray guide tube 3 may be disposed. This eliminates the necessity of the provision of the mount base 4 which makes the X-ray guide tube 3 slide.

Moreover, the protective pipe unit 5 protecting the X-ray guide tube 3 is not limited to the type which is disposed at the side of the output and extending from the position determined by the aforementioned formulae (1) and (2) but may be of a type which protects almost the entire length extending from the input end up to a position which lies a little short of the output end. Also, various modifications are possible, for instance, the protective pipe unit 5 may be disposed not on the mount base 4 but on the X-ray source 2.

As stated in detail, according to the leaking X-ray shielding mechanism of the present invention, X-rays can be narrowed by the X-ray guide tube and X-rays which leak from the side surface of the X-ray guide tube can be blocked. Briefly, the X-ray cartridge has two abilities of forming the fine beams of the X-rays Rx and providing shielding from the X-rays Rx.

Especially, when the relation, $r_1/x_1<r_2/x_2$, is established between the diameter $r_1$ of the entrance window of the X-ray shielding plate, the distance $x_1$ from the X-ray generated point of the X-ray source to the X-ray shielding plate, the distance $x_2$ from the X-ray generated point to the input end of the protective pipe and the inside diameter of $r_2$ of the protective pipe, leaking X-rays can be blocked only by X-ray shielding of a limited range, which reduces the production cost that much more.

In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A fluorescent X-ray spectroscope comprising:

a source of X-rays having an X-ray generating point;

an X-ray shielding plate having an entrance window to emit X-rays from the X-ray generating point;

a first elongated glass tube having a first aperture extending the length of the first glass tube for guiding the X-rays;

a sample stage aligned with one end of the first glass tube to receive the X-rays; and a first protective X-ray tube positioned about the first glass tube and extending substantially along an intermediate length of the first glass tube to block off-axis X-rays that are not aligned with the first aperture of the first glass tube.

2. The invention of claim 1 further including a mount base for holding the first protective X-ray tube.

3. The invention of claim 2 further including a second elongated glass tube with a second aperture of a size different than the first aperture and a second protective X-ray tube positioned about the second glass tube and held in the mount base.

4. The invention of claim 3 wherein the mount base includes an X-ray shielding tube extending upward from the mount base to the X-ray shielding base.

5. The invention of claim 4 wherein the respective first and second glass tubes extend within the X-ray shielding tube and the first and second protective X-ray tubes extend below the X-ray shielding tube.

6. The invention of claim 5 wherein the entrance window has a diameter of $r_1$, the first protective X-ray tube has an inside diameter of $r_2$, $x_1$ is a distance from an X-ray generating point of the source of X-rays to the X-ray shielding plate and $x_2$ is a distance from the X-ray generating point to an input end of the first protective X-ray tube wherein the following condition applies:

$$r_1/x_1<r_2/x_2$$

7. An X-ray shielding mechanism for off-axis X-rays provided with an X-ray cartridge comprising:

an X-ray source which radiates X-rays;

a glass X-ray guide tube with an inner peripheral surface into which the X-rays are introduced;

an X-ray shielding plate made of metal and having a window for introducing X-rays into the X-ray guide tube, the shielding plate is disposed on an input end of the X-ray guide tube, and a metallic protective pipe which has a predetermined length extending from the side of the input end at a predetermined distance from the X-ray source to the side of the end, from which the X-rays are emitted, and which is disposed outside of the X-ray guide tube whereby the X-rays which pass through the entrance window and are transmitted from a side surface of the X-ray guide tube can be blocked and satisfying the following condition:

$$r_1/x_1<r_2/x_2$$

wherein $r_1$ is a diameter of the entrance window of the X-ray shielding plate, $x_1$ is a distance from an X-ray generation point of the X-ray source to the X-ray shielding plate, $x_2$ is a distance from the X-ray generation point to an input end of the protective pipe and $r_2$ is the inside diameter of the protective pipe.

8. An X-ray shielding mechanism of claim 7 wherein the X-ray cartridge has a plurality of X-ray guide tubes and a mount base which supports these X-ray guide tubes and switches the X-ray guide tubes relative to the X-ray source.

9. An X-ray shielding mechanism of claim 8 wherein the mount base supports the metallic X-ray shielding pipe positioned on the outside of the X-ray guide tube and the X-ray shielding plate positioned on the side of the input end of the X-ray guide tube is supported by an X-ray shielding pipe.

10. In an X-ray analytical instrument for applying and analyzing the consequence of X-rays applied to a sample, the improvement of:

an elongated glass guide tube for guiding X-rays to the sample from a source of X-rays; and an outer metallic tube of sufficient density and length to block X-rays extending about the elongated glass guide tube whereby off-axis X-rays transmitted through an outer surface of the guide tube are blocked, wherein the X-ray analytical instrument includes an entrance window in an X-ray shielding plate having a diameter $r_1$, the metallic tube has an inside diameter of $r_2$, $x_1$ is a distance from an X-ray generating point of an X-ray source to the X-ray shielding plate and $x_2$ is a distance from the X-ray generating point to an input end of the metallic tube wherein the following condition applies:

$$r_1/x_1<r_2/x_2$$

11. In an X-ray analytical instrument for applying and analyzing the consequence of X-rays applied to a sample, the improvement of an elongated glass guide tube for guiding X-rays to the sample from a source of X-rays; and an outer stainless steel tube of sufficient density and length to block X-rays extending about the elongated glass guide tube whereby off-axis X-rays transmitted through an outer surface of the guide tube are blocked, wherein the X-ray analytical instrument includes an entrance window in an X-ray shielding plate having a diameter $r_1$, the stainless steel tube has an inside diameter of $r_2$, $x_1$ is a distance from an X-ray generating point of an X-ray source to the X-ray shielding plate and $x_2$ is a distance from the X-ray generating point to an input end of the stainless steel tube wherein the following condition applies:

$$r_1/x_1<r_2/x_2.$$

* * * * *